US011692798B2

(12) United States Patent
Blais et al.

(10) Patent No.: US 11,692,798 B2
(45) Date of Patent: Jul. 4, 2023

(54) ELECTRICAL IGNITER ASSEMBLY FOR INCENDIARY AND EXPLOSIVE DEVICES

(71) Applicant: SOUTHWEST RESEARCH INSTITUTE, San Antonio, TX (US)

(72) Inventors: Matthew S. Blais, Lakehills, TX (US); Kyle C. Fernandez, San Antonio, TX (US); Bernardo Garcia, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 16 days.

(21) Appl. No.: 17/643,004

(22) Filed: Dec. 7, 2021

(65) Prior Publication Data

US 2023/0175820 A1 Jun. 8, 2023

(51) Int. Cl.
*F42B 3/26* (2006.01)

(52) U.S. Cl.
CPC ..... *F42B 3/26* (2013.01)

(58) Field of Classification Search
CPC ..... F42B 3/26
USPC ..... 102/202.12
See application file for complete search history.

(56) References Cited

U.S. PATENT DOCUMENTS 2,192,542 A * 3/1940 De Benedetti ..... F23Q 2/287 290/1 R
3,931,763 A * 1/1976 Bluhm ..... F42B 3/195 102/318
4,425,849 A * 1/1984 Jorgenson ..... F42B 3/18 102/275.12
4,527,482 A * 7/1985 Hynes ..... F42B 3/26 102/318
5,645,298 A * 7/1997 Stevens ..... B60R 21/2644 280/741
5,698,812 A 12/1997 Song
8,453,573 B1 * 6/2013 McKimm ..... F42C 19/02 102/487
9,528,803 B1 12/2016 Kim et al.
2009/0223400 A1 * 9/2009 Hill ..... F42D 1/055 102/202.7
2012/0192748 A1 * 8/2012 Scheid ..... F42B 3/26 403/221
2013/0291751 A1 * 11/2013 Sickels ..... F42B 3/006 439/625
2014/0352568 A1 * 12/2014 Benson ..... F42B 3/02 102/331
2017/0074078 A1 * 3/2017 Eitschberger ..... F42D 1/045
2017/0184379 A1 * 6/2017 Barzilai ..... F42B 3/02
2019/0241352 A1 * 8/2019 Henck ..... F42B 3/10
2022/0251930 A1 * 8/2022 Koon ..... E21B 43/119

FOREIGN PATENT DOCUMENTS

EP 0189627 8/1986

* cited by examiner

*Primary Examiner* — Samir Abdosh
(74) *Attorney, Agent, or Firm* — Grossman, Tucker, Perreault & Pfleger, PLLC

(57) ABSTRACT

An electrical igniter for incendiary and explosive devices. In particular, an electrical igniter assembly comprising two component parts including a cap and well where an ignition or detonation mixture may then be positioned within the well along with electrical leads.

17 Claims, 2 Drawing Sheets

ELECTRICAL IGNITER ASSEMBLY FOR INCENDIARY AND EXPLOSIVE DEVICES

FIELD

The present invention is directed at an electrical igniter for incendiary and explosive devices. In particular, an electrical igniter assembly comprising two component parts including a cap and well where an ignition or detonation mixture may then be positioned within the well along with electrical leads.

BACKGROUND

Thermite destructive devices are reported in the art. For example, U.S. Pat. No. 8,453,573 discloses a primer adapter for a hand grenade of different configurations to use the same primer for ignition of their explosive trains. European Patent Application 0 189 627 discloses an electric fired pyrotechnic grenade, for the generation of a smoke screen, comprising propellant and disperser charges ignitable by an electric squib. U.S. Pat. No. 5,698,812 discloses a destructive device containing a thermite-type composition having a core burning configuration.

Thermite grenades are a type of explosive incendiary ordinance. Thermite ignition can present various problems, as the ignition can be unreliable. For example, thermite can require temperatures of over 3,000° F. to start the explosive reaction. Typical ignition of thermite relies upon a magnesium ribbon sparkler which can reach temperatures sufficiently high for thermite ignition.

Accordingly, there remains a continuing need to develop new grenade igniters, and in particular, it would be highly useful to develop an electrical igniter that provides reliable remote detonation or ignition of incendiary or explosive devices via electrical impulses.

SUMMARY

An igniter assembly for incendiary or explosive devices comprising an igniter cap configured to mechanically engage with an igniter body well portion, the igniter cap including one or a plurality of openings for one or a plurality of electrical wire connection leads and an interior hollow projection that is configured to project into at least a portion of the igniter body well portion. The igniter assembly also includes an igniter body well portion that is configured to mechanically engage with the igniter cap and to receive the igniter cap hollow projection, wherein the igniter cap with the interior hollow projection, when engaged to the igniter body well portion, defines a variable volume chamber to contain a selected amount of ignition or detonation compositions.

A method for providing an incendiary or explosive device for detonation comprising supplying an igniter cap configured to mechanically engage with an igniter body well portion, the igniter cap including one or a plurality of openings for one or a plurality of electrical wire connection leads and an interior hollow projection that is configured to project into at least a portion of the igniter body well portion. One also supplies an igniter body well portion that is configured to mechanically engage with the igniter cap and to receive the igniter cap hollow projection wherein the igniter cap with the interior hollow projection, when engaged to the igniter body well portion, defines a variable volume chamber to contain a selected amount of ignition or detonation compositions. One then supplies the one or plurality of electrical connection leads and places the one or plurality of electrical connection leads in the opening in the igniter cap and through the interior hollow projection and into the variable volume chamber. This may then be followed by connecting the electrical connection leads in the variable volume chamber to an igniter squib and placing a selected amount of ignition or detonation composition into the variable volume chamber. This may then be followed by mechanically engaging the igniter cap and the igniter well portion with an incendiary or explosive device.

DETAILED DESCRIPTION OF THE DRAWINGS

Figure 1:
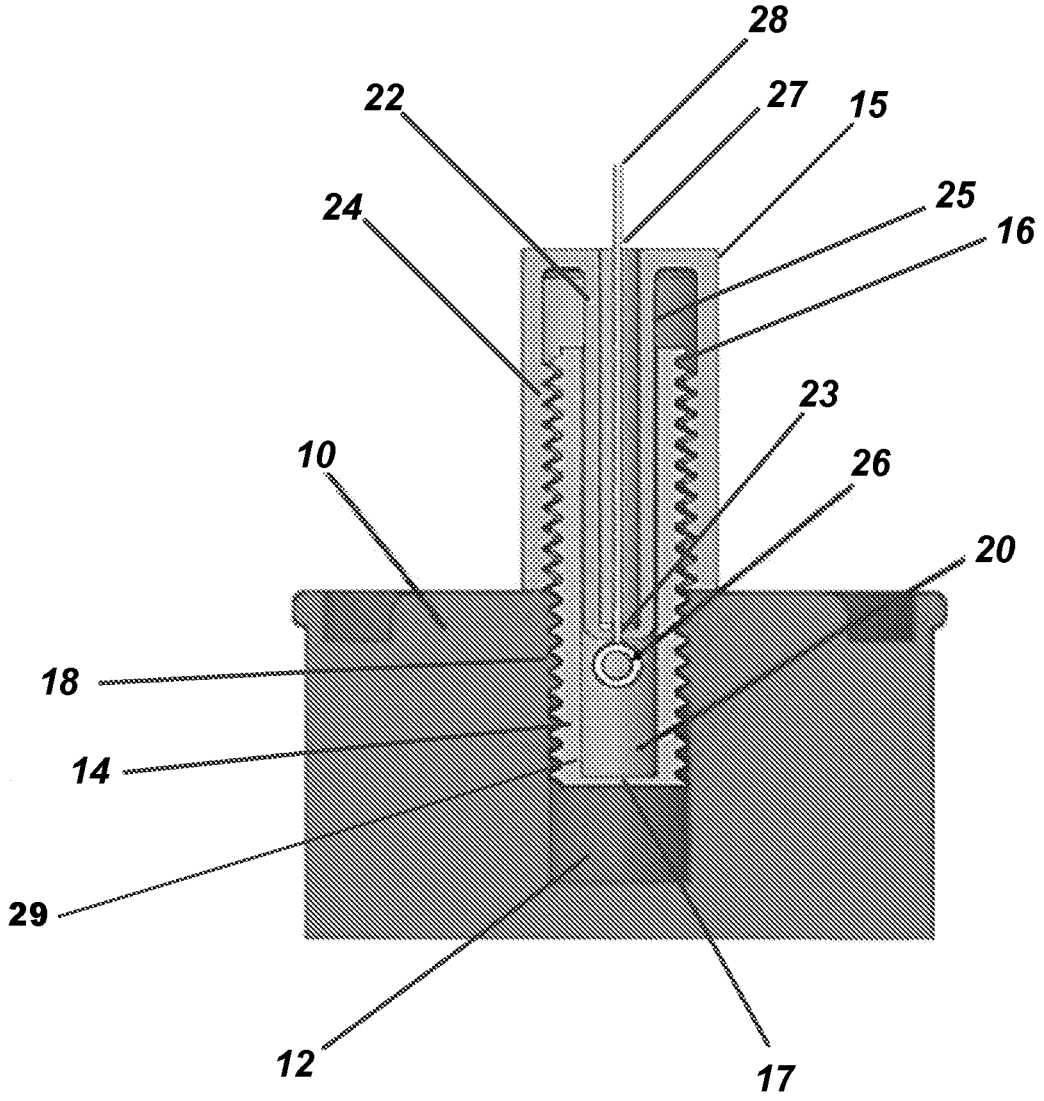
FIG. 1 provides a cross-sectional view of the electrical igniter herein within an incendiary or exploding device.

FIG. 1 provides a cross-sectional view of a preferred embodiment of the electrical igniter disclosed herein within an incendiary or exploding device. Specifically, an incendiary or exploding device appears at 10, which includes an opening 12 for insertion and ultimate mechanical engagement of an igniter body well portion 14 with an igniter cap 15. As illustrated, preferably, igniter body well portion 14 is configured with exterior threads 16 that can engage with internal threads 18 of the incendiary or exploding device 10. The igniter body well portion 14 also includes a cap 17 that may be integrally formed with the igniter body well portion 14 or be attached thereto.

Igniter cap 15 is configured to be placed over the igniter body well portion 14 and become mechanically engaged thereto. Preferably the ignitor cap 15 has internal threads 24 that engage with the exterior threads 16 of the ignitor body well portion 14. The igniter cap 15 also provides one or a plurality of openings at 27 for insertion of one or a plurality of electrical wire connection leads 28, wherein only one such wire opening are shown in FIG. 1. The electrical wire connection leads 28 preferably have an American Wire Gauge (AWG) in the range of 10-20.

Also shown at 26 is the igniter squib wire which is attached to the electrical wire connection leads 28 which leads extend through the hollow projection and into variable volume chamber 20, described more fully herein. Preferably, the igniter squib wire 26 is comprised of nickel chromium alloy, with a gauge in the range of 20 to 30, more preferably 20 to 25. The igniter squib wire also is preferably in the form of a coil, having a coil diameter in the range of 0.10" to 0.20", more preferably 0.10" to 0.15".

More specifically, the interior of the igniter cap 15 preferably includes a hollow projecting component 22 that projects and extends into the igniter body well portion 14 into which the one or more electrical wire connections leads 28 are contained and readily positioned. The hollow projection component 22 of the igniter cap also includes a relatively small opening at 23 for attachment to the igniter squib wire 26. Accordingly, the hollow projection component 22 of the igniter cap 15 is configured so that as illustrated, it will contain wire connection leads 28 which leads then project into variable volume chamber 20 of said body well portion 14. The hollow projection component 22 of the igniter cap 15 that extends within the body well portion 15 is also preferably sized so that its own outer surface 25 is frictionally engaged to the inner surface 29 of the body well portion 14.

As may now be appreciated, the igniter cap 15 along with its hollow projection component 22 that extends into at least a portion of the body well component 14, defines at 20 a variable volume chamber to contain a selected amount of ignition or detonation compositions. Such variable volume may preferably range between 1.0 cc to 15.0 cc, more preferably 1.0 cc to 10.0 cc, or even more preferably in the range of 1.0 cc to 5.0 cc. Reference to "cc" is reference to cubic centimeters.

The detonation compositions positioned within variable volume chamber 20 are preferably selected from a potassium perchlorate ($KClO_4$) mixture with a metal such as iron (Fe). Other detonation compositions include oxidizers in general such as permanganates or chromates in combination with metals such as aluminum or titanium. In addition, it is contemplated that one may utilize lead azide or mercury fulminate. The amount of such ignition or detonation compositions preferably falls in the range of 0.5 grams to 5.0 grams, or more preferably, 0.5 grams to 3.0 grams.

Figure 2:
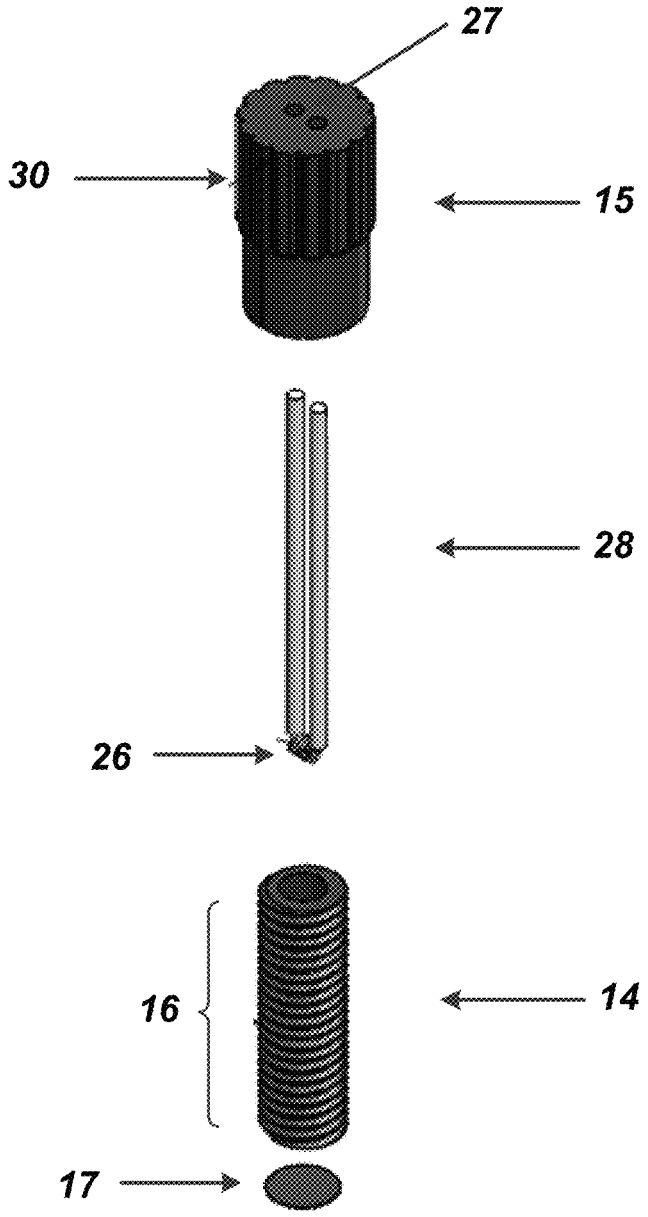
FIG. 2 provides a component view of the electrical igniter herein, and how it may be configured for attachment to an incendiary or explosive device.

FIG. 2 provides a further illustration of the preferred electrical igniter herein, in component form. Specifically, the igniter cap 15 can be seen and as alluded to above, the cap preferably includes two openings at 27 for electrical leads 28 that may then be connected to an electrical source. The electrical source may preferably comprise a 1.5 Volt to 12 Volt DC source or any 110 Volt AC outlet. The igniter cap 15 preferably has a length in the range of 1.0 inch to 2.0 inches with an outer diameter of 0.5 inch to 1.5 inch. The igniter cap 15 may also preferably include an outer gripping portion at 30 to facilitate attachment to body well portion 14. That is, one can readily grip and rotate igniter cap 15 so that the internal threads 24 of the igniter cap (see FIG. 1) engage with external threads 16 on the exterior of body well portion 14. The external threads of the body well portion 14, as also noted above, also engage with the internal threads 18 of the incendiary or exploding device 10. The body well portion preferably has a length that is greater than the length of the ignited cap 15 and can preferably fall in the range of 1.5 inches to 2.0 inches, with an outer diameter in the range of 0.5 inch to 1.25 inch. As also alluded to above, one may have a separate cap portion 17 that attaches to the bottom of body well portion 14.

The electrical igniter assembly comprising the igniter cap 15 and body well portion 14 can be preferably formed herein by the process of additive manufacturing or 3D printing. Such may include vat photopolymerization, material jetting, sheet lamination, binder jetting, directed energy deposition, or powder bed fusion. Preferred resins for construction of the igniter cap 15 and body well portion 14 include thermoplastic polymers. In one particularly preferred embodiment, fused deposition modeling (FDM) is utilized to form the igniter cap 15 and body well portion from poly(ethylene terephthalate) otherwise known as PET.

The electrical igniter assembly herein is one that now provides for remote detonation or ignition of incendiary or explosive devices by electrical impulse. The electrical igniter assembly herein successfully was observed to ignite, e.g., both M-14 TH3 and EIG thermite type grenades. The electrical igniter assembly therefore may provide the ability for conversion of manually triggered munitions to a command initiated remote system to allow for relatively safer operation. The electrical igniter assembly is therefore contemplated to have particular utility for ignition of EIG and M-14 thermite grenades.

The foregoing description of several preferred embodiments has been presented for purposed of illustration. It is not intended to be exhaustive or to limit the claims to the precise structures or procedures disclosed to provide the igniter assembly herein.

The invention claimed is:

1. An igniter assembly for incendiary or explosive devices comprising:

a. an igniter cap configured to mechanically engage with an igniter body well portion, said igniter cap including one or a plurality of openings for one or a plurality of electrical wire connection leads and an interior hollow projection that is configured to project into at least a portion of said igniter body well portion;

b. an igniter body well portion that is configured to mechanically engage with said igniter cap and to receive said igniter cap hollow projection;

wherein said igniter cap with said interior hollow projection, when engaged to said igniter body well portion, defines a variable volume chamber to contain a selected amount of ignition or detonation compositions.

2. The igniter assembly of claim 1 wherein said igniter cap includes inner threads and said body well portion includes outer threads and said inner threads of said igniter cap are configured to engage with said outer threads of said body well portion.

3. The igniter assembly of claim 1 wherein said variable volume chamber has a volume in the range of 1.0 cc to 15.0 cc.

4. The igniter assembly of claim 1 wherein said igniter cap has a length in the range of 1.0 inch to 2.0 inches.

5. The igniter assembly of claim 1 wherein said igniter well portion has a length in the range of 1.5 inches to 2.0 inches.

6. The igniter assembly of claim 1, further including one or a plurality of electrical wire connection leads.

7. The igniter assembly of claim 6 wherein said electrical wire connection leads extend into said variable volume chamber and are connected to an igniter squib.

8. The igniter assembly of claim 1 wherein said variable volume chamber has a volume in the range of 1.0 cc to 15.0 cc.

9. The igniter assembly of claim 7 wherein said electrical wire connection leads are connected to an electrical source providing 1.5 Volt to 12 Volts DC.

10. The igniter assembly of claim 1 wherein said igniter well portion is mechanically engaged to an incendiary or exploding device.

11. A method for providing an incendiary or explosive device for detonation comprising:

a. supplying an igniter cap configured to mechanically engage with an igniter body well portion, said igniter cap including one or a plurality of openings for one or a plurality of electrical wire connection leads and an interior hollow projection that is configured to project into at least a portion of said igniter body well portion;

b. supplying an igniter body well portion that is configured to mechanically engage with said igniter cap and to receive said igniter cap hollow projection wherein said igniter cap with said interior hollow projection, when engaged to said igniter body well portion, defines a variable volume chamber to contain a selected amount of ignition or detonation compositions;

c. supplying said one or plurality of electrical connection leads and placing said one or plurality of electrical connection leads in said opening in said igniter cap and through said interior hollow projection and into said variable volume chamber, d. connecting said electrical connection leads in said variable volume chamber to an igniter squib;

e. placing a selected amount of ignition or detonation composition into said variable volume chamber;

f. mechanically engaging said igniter cap and said igniter well portion with an incendiary or explosive device.

12. The method of claim 11 wherein said igniter cap includes inner threads and said body well portion includes outer threads and said inner threads of said igniter cap are configured to engage with said outer threads of said body well portion.

13. The method of claim 11 wherein said variable volume chamber has a volume in the range of 1.0 cc to 15.0 cc.

14. The method of claim 11 wherein said igniter cap has a length in the range of 1.0 inch to 2.0 inches.

15. The method of claim 11 wherein said igniter well portion has a length in the range of 1.5 inches to 2.0 inches.

16. The method of claim 11 wherein said variable volume chamber has a volume in the range of 1.0 cc to 15.0 cc.

17. The method of 16 wherein said electrical wire connection leads are connected to an electrical source providing 1.5 Volt to 12 Volts DC.

* * * * *